US007874792B2

(12) United States Patent
Tholen et al.

(10) Patent No.: US 7,874,792 B2
(45) Date of Patent: Jan. 25, 2011

(54) BLADE OUTER AIR SEALS, CORES, AND MANUFACTURE METHODS

(75) Inventors: Susan M. Tholen, Kennebunk, ME (US); Paul M. Lutjen, Kennebunkport, ME (US)

(73) Assignee: United Technologies Corporation, Hartford, CT (US)

( * ) Notice: Subject to any disclaimer, the term of this patent is extended or adjusted under 35 U.S.C. 154(b) by 776 days.

(21) Appl. No.: 11/865,229

(22) Filed: Oct. 1, 2007

(65) Prior Publication Data

US 2009/0087306 A1 Apr. 2, 2009

(51) Int. Cl.
*F01D 25/12* (2006.01)

(52) U.S. Cl. ..... 415/173.1; 415/115

(58) Field of Classification Search ..... 415/170, 415/173.1, 115, 116; 164/516, 369
See application file for complete search history.

(56) References Cited

U.S. PATENT DOCUMENTS

| | | | | |
|---|---|---|---|---|
| 5,486,090 | A * | 1/1996 | Thompson et al. | 415/173.1 |
| 5,538,393 | A * | 7/1996 | Thompson et al. | 415/115 |
| 5,609,469 | A * | 3/1997 | Worley et al. | 415/173.1 |
| 7,650,926 | B2 * | 1/2010 | Tholen | 164/516 |
| 7,686,068 | B2 * | 3/2010 | Tholen et al. | 164/369 |

* cited by examiner

*Primary Examiner*—Igor Kershteyn
(74) *Attorney, Agent, or Firm*—Bachman & LaPointe, P.C.

(57) ABSTRACT

A blade outer air seal (BOAS) casting core has first and second end portions and a plurality of legs. Of these legs, first legs each have: a proximal end joining the first end portion; a main body portion; and a free distal portion. Second legs each have: a proximal end joining the second end portion; a main body portion; and a free distal portion.

20 Claims, 6 Drawing Sheets

BLADE OUTER AIR SEALS, CORES, AND MANUFACTURE METHODS

BACKGROUND

The disclosure relates to gas turbine engines. More particularly, the disclosure relates to casting of cooled shrouds or blade outer air seals (BOAS).

BOAS segments may be internally cooled by bleed air. For example, there may be an upstream-to-downstream array of circumferentially-extending cooling passageway legs within the BOAS. Cooling air may be fed into the passageway legs from the outboard (OD) side of the BOAS (e.g., via one or more inlet ports at ends of the passageway legs). The cooling air may exit the legs through outlet ports in the circumferential ends (matefaces) of the BOAS so as to be vented into the adjacent inter-segment region. The vented air may, for example, help cool adjacent BOAS segments and purge the gap to prevent gas ingestion.

The BOAS segments may be cast via an investment casting process. In an exemplary casting process, a ceramic casting core is used to form the passageway legs. The core has legs corresponding to the passageway legs. The core legs extend between first and second end portions of the core. The core may be placed in a die. Wax may be molded in the die over the core legs to form a pattern. The pattern may be shelled (e.g., a stuccoing process to form a ceramic shell). The wax may be removed from the shell. Metal may be cast in the shell over the core. The shell and core may be destructively removed. After core removal, the core legs leave the passageway legs in the casting. The as-cast passageway legs are open at both circumferential ends of the raw BOAS casting. At least some of the end openings are closed via plug welding, braze pins, or other means. Air inlets to the passageway legs may be drilled from the OD side of the casting.

SUMMARY

One aspect of the disclosure involves a blade outer air seal (BOAS) casting core. The core has first and second end portions and a plurality of legs. Of these legs, first legs each have: a proximal end joining the first end portion; a main body portion; and a free distal portion. Second legs each have: a proximal end joining the second end portion; a main body portion; and a free distal portion.

In various implementations, the distal portions of the first and second legs may project transverse to the main body portion. The core may be formed of refractory metal sheetstock. The core may have a ceramic coating. The proximal portions may each comprise a reduced cross-section neck. At least one third leg may connect to the first end portion to the second end portion. The at least one third leg may include first and second perimeter or edge legs. A plurality of connector branches may connect adjacent pairs of the legs. The connector branches may have minimum cross-sections smaller than adjacent cross-sections of the connected legs.

The core may be embedded in a shell and a casting cast partially over the core. The first and second end portions of the core may project from the casting into the shell. The first and second leg distal portions may project into the shell or may terminate in the casting.

The core may be manufactured by cutting from a refractory metal sheet. After the cutting, the first and second leg distal portions may be bent transverse to associated main body portions of those legs.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
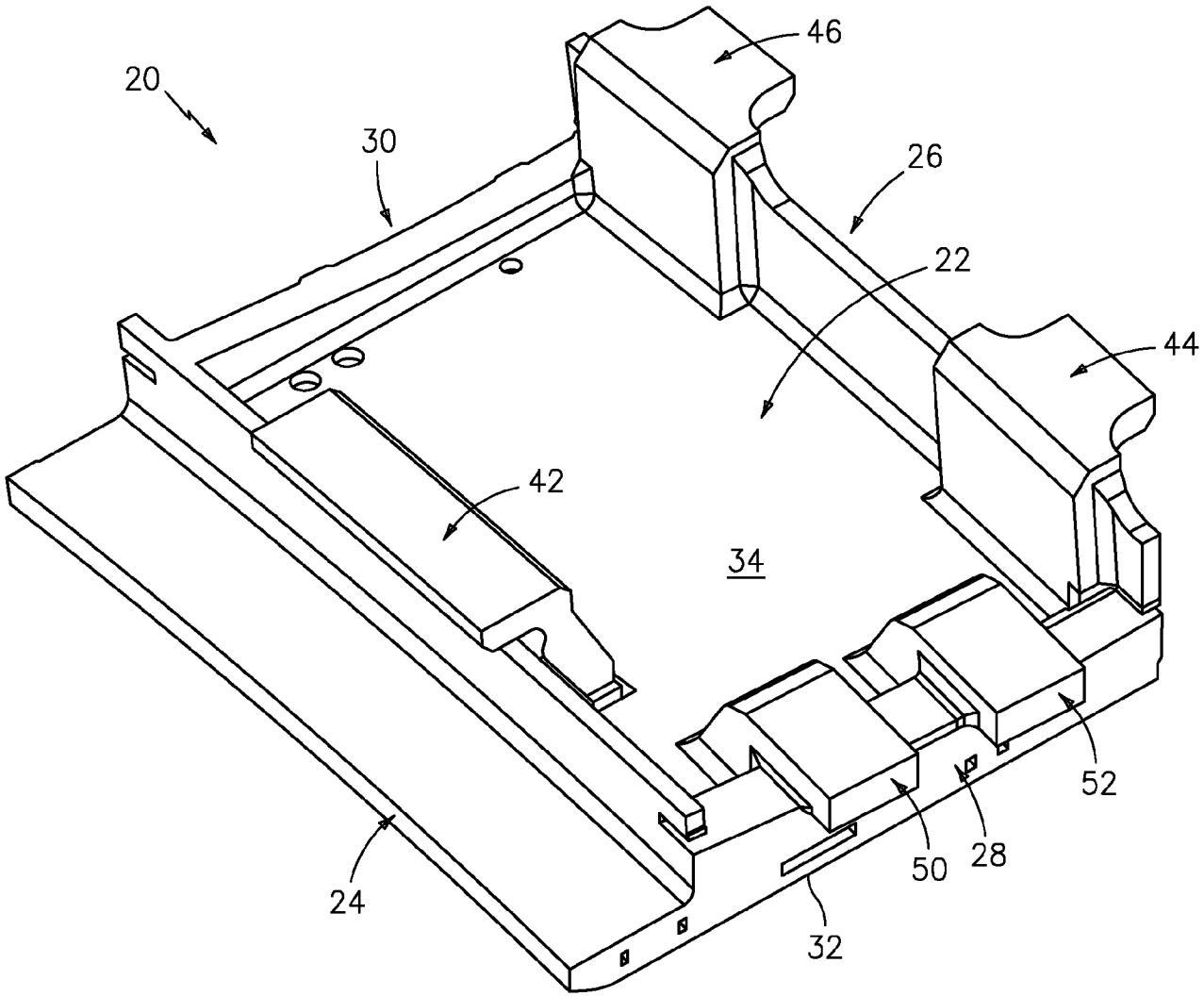
FIG. 1 is a view of a blade outer airseal (BOAS)

FIG. 1 shows blade outer air seal (BOAS) 20. The BOAS has a main body portion 22 having a leading/upstream/forward end 24 and a trailing/downstream/aft end 26. The body has first and second circumferential ends or matefaces 28 and 30. The body has an ID face 32 and an OD face 34. To mount the BOAS to a support structure 40 (FIG. 3; e.g., a portion of the engine case), the exemplary BOAS has a plurality of mounting hooks. The exemplary BOAS has a single central forward mounting hook 42 having a forwardly-projecting distal portion recessed aft of the forward end 24. The exemplary BOAS has a pair of first and second aft hooks 44 and 46 having rearwardly-projecting distal portions protruding aft beyond the aft end 26.

Figure 3:
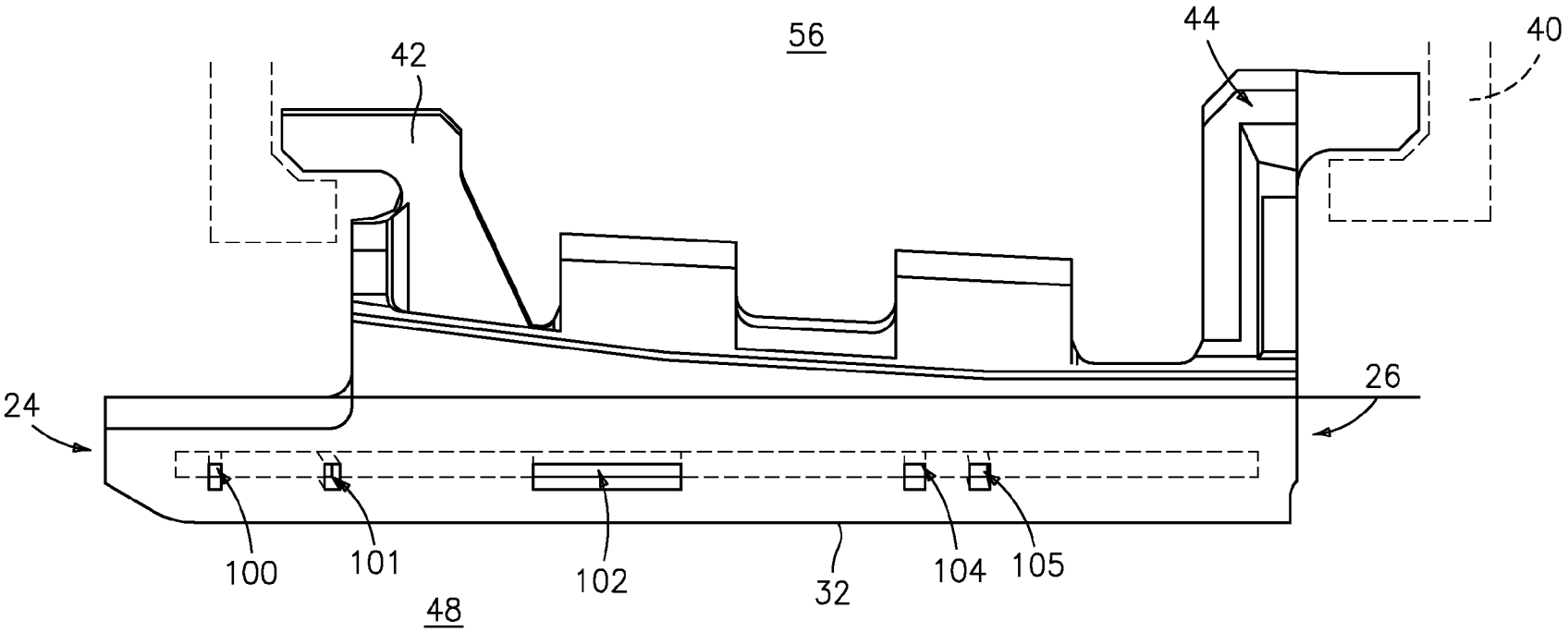
FIG. 3 is a first circumferential end view of the BOAS of FIG. 1.
Figure 4:
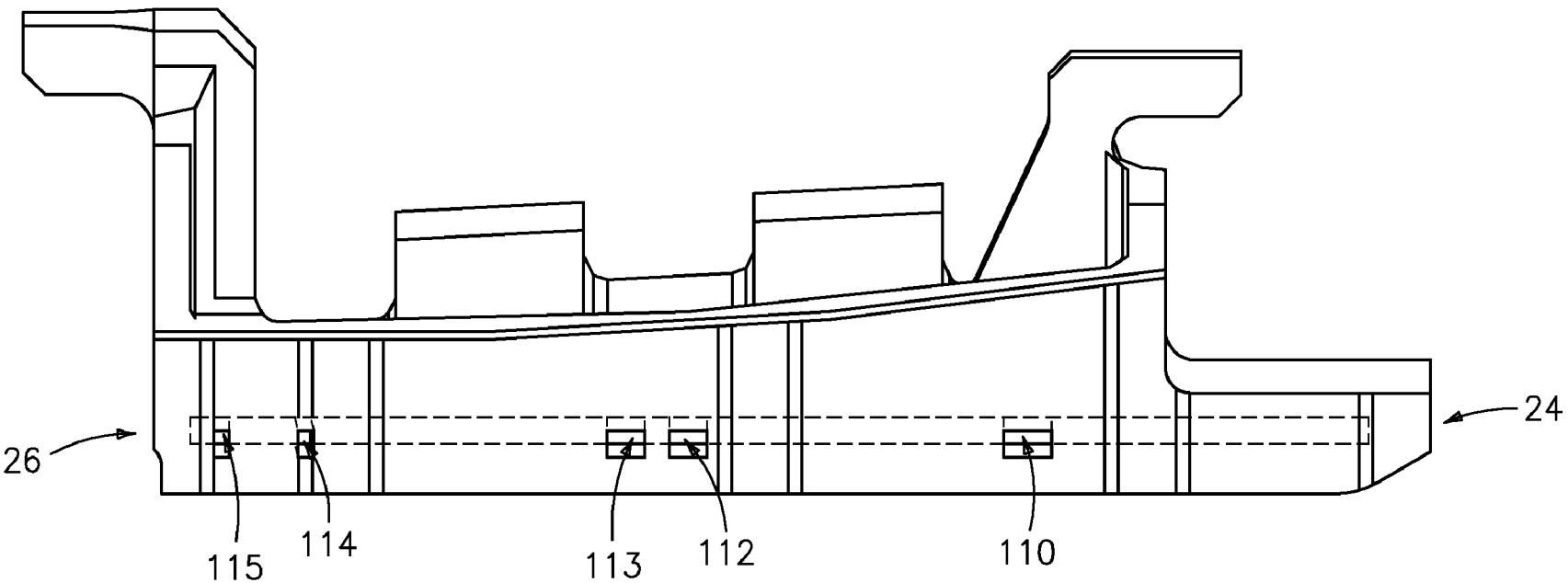
FIG. 4 is a second circumferential end view of the BOAS of FIG. 1.

A circumferential ring array of a plurality of the BOAS 22 may encircle an associated blade stage of a gas turbine engine. The assembled ID faces 32 thus locally bound an outboard extreme of the core flowpath 48 (FIG. 3). The BOAS 22 may have features for interlocking the array. Exemplary features include finger and shiplap joints. The exemplary BOAS 22 has a pair of fore and aft fingers 50 and 52 projecting from the first circumferential end 28 and which, when assembled, radially outboard of the second circumferential end 30 of the adjacent BOAS.

Figure 2:
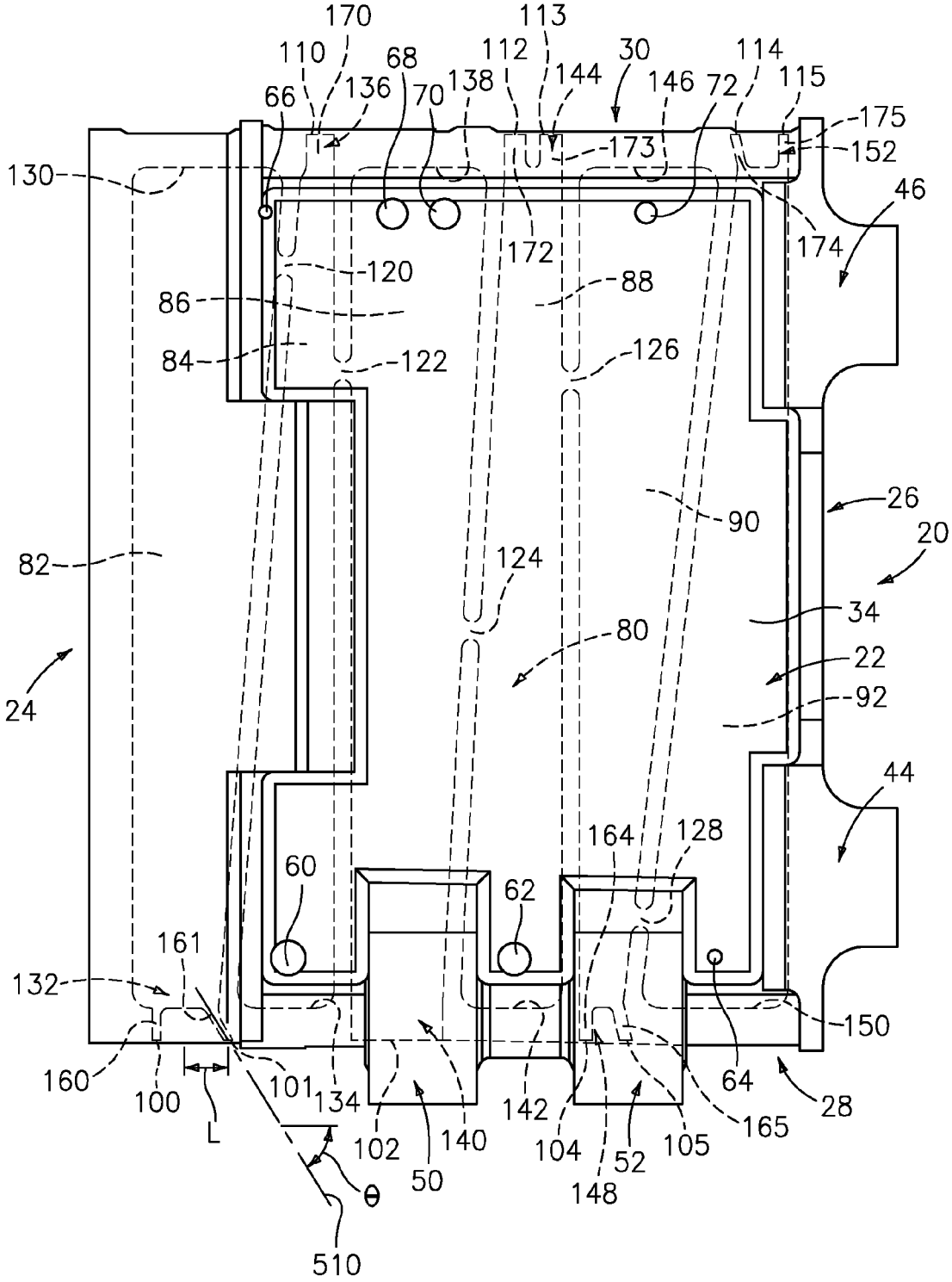
FIG. 2 is an OD/top view of the BOAS of FIG. 1.

The BOAS may be air-cooled. For example, bleed air may be directed to a chamber 56 (FIG. 3) immediately outboard of the face 34. The bleed air may be directed through ports 60, 62, 64, 66, 68, 70, and 72 (FIG. 2) to an internal cooling passageway network 80. The configuration of the exemplary BOAS 20 is based upon the configuration shown in U.S. patent application Ser. No. 11/502,046. Nevertheless, the principles discussed below may be applied to other BOAS configurations (e.g., in a reengineering situation). The exemplary network includes a plurality of circumferentially-extending legs 82, 84, 86, 88, 90, and 92. The network may have a plurality of outlets/exits. Exemplary outlets may include outlets along the circumferential ends 28 and 30. In the exemplary BOAS 22, outlets 100, 101, 102, 104, and 105 are formed along the first circumferential end 28 and outlets 110, 112, 113, 114, and 115 are formed along the second circumferential end 30. As is discussed in further detail below, adjacent legs may be interconnected by interconnecting passageways 120, 122, 124, 126, and 128.

In operation, the inlet 66 feeds the leg 82 near a closed end 130 of the leg 82. The air flows down the leg 82 to the outlets 100 and 101 at ends of outlet passageways 160 and 161. The exemplary passageways 160 and 161 are formed as twin neck regions or branches at the other end 132 of the leg 82. Similarly, the inlet 60 feeds the leg 84 near a closed end 134. The outlet 110 is at an end of an outlet passageway 170 formed as a neck region at the other end 136. The inlets 68 and 70 feed the leg 86 near a closed end 138. The outlet 102 is formed at the other end 140. The inlet 62 feeds the leg 88 near a closed end 142. The dual outlets 112 and 113 are at ends of outlet passageways 172 and 173 at the other end 144. The inlet 72 feeds the leg 90 near a closed end 146. The dual outlets 104 and 105 are at ends of outlet passageways 164 and 165. The exemplary passageways 164 and 165 are formed as neck regions at the other end 148. The inlet 64 feeds the leg 92 near a closed end 150. The dual outlets 114 and 115 are at ends of outlet passageways 164 and 165. The exemplary passageways 164 and 165 are formed as neck regions at the other end 152.

Figure 5:
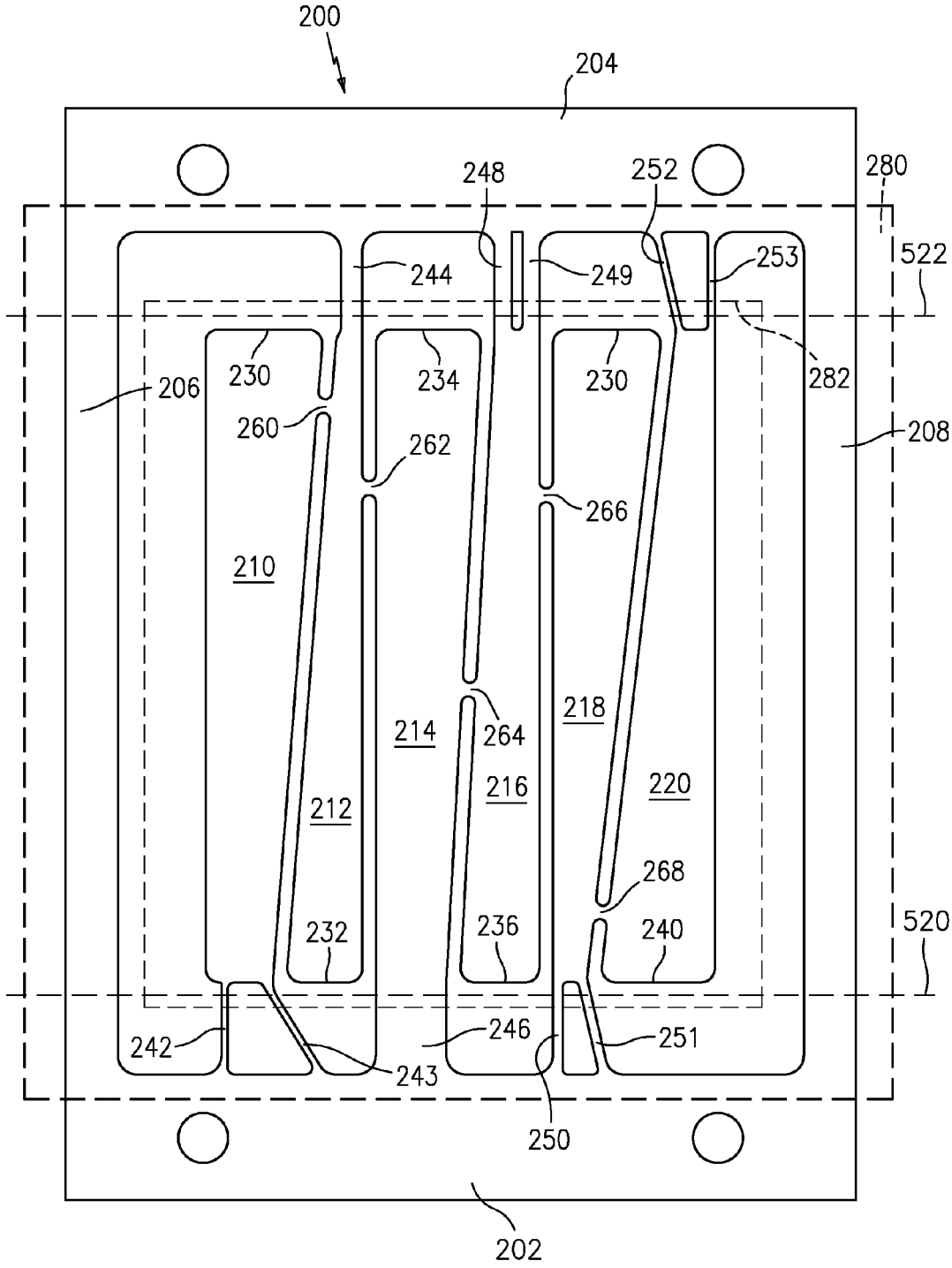
FIG. 5 is a plan view of a refractory metal core (RMC) for casting a cooling passageway network of the BOAS of FIG. 1.

FIG. 5 shows a refractory metal core (RMC) 200 for casting the passageway legs. The core 200 may be cut from a metallic sheet (e.g., of a refractory metal). An exemplary cutting is laser cutting. Alternative cutting may be via a stamping operation. The exemplary RMC 200 has first and second end portions 202 and 204. First and second perimeter legs 206 and 208 extend between and join the end portions 202 and 204 to form a frame-like structure. Between the perimeter legs 206 and 208, there is an array of legs 210, 212, 214, 216, 218, and 220 which respectively cast the passageway legs 82, 84, 86, 88, 90, and 92. In an exemplary implementation, each of the RMC legs has a proximal end joining the adjacent one of the end portions 202 and 204 and a free distal end spaced apart from the other end portion. A main body of the leg extends between the proximal and distal ends. In the exemplary implementation, the core leg distal ends 230, 232, 234, 236, 238, and 240 respectively cast the passageway leg closed ends 130, 134, 138, 142, 146, and 150. The core leg proximal ends have branches 242, 243; 244; 246; 248, 249, 250, 251; and 252, 253 which respectively cast the outlets 100, 101; 110; 102; 112, 113; 104, 105; and 114, 115.

Figure 6:
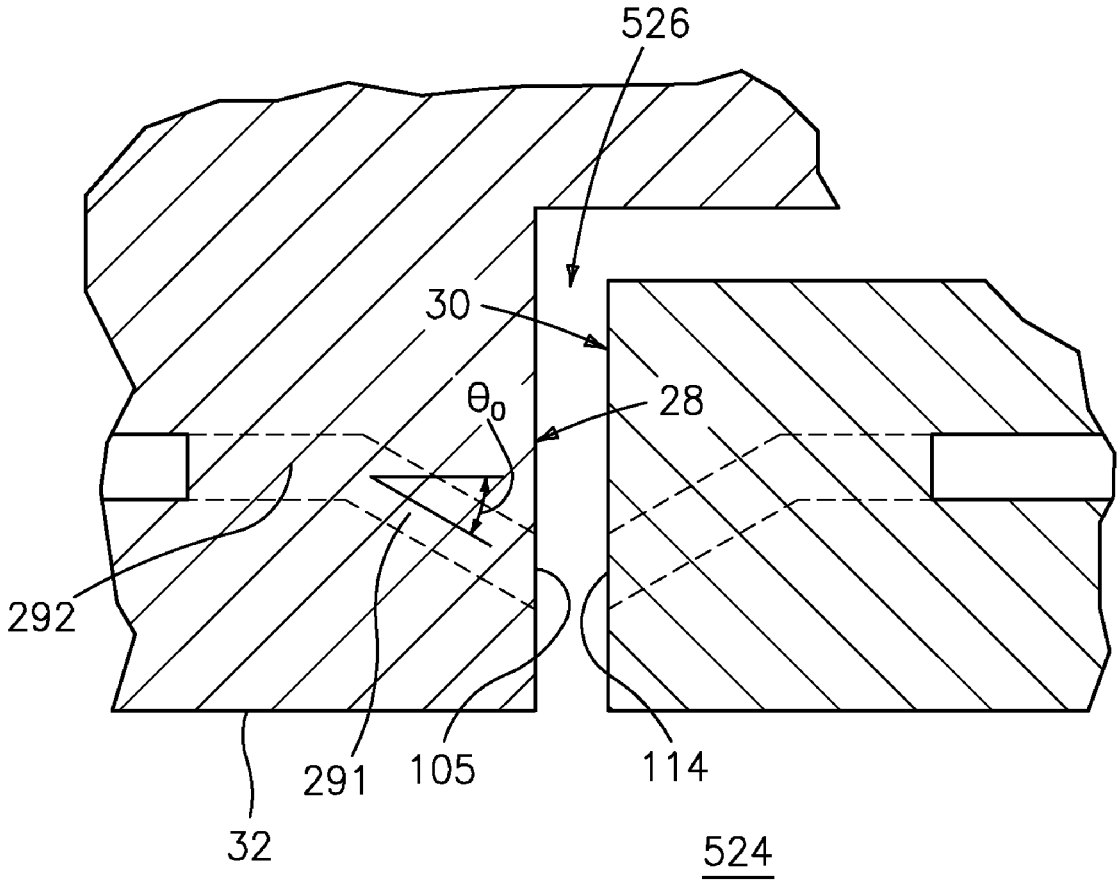
FIG. 6 is a sectional view of a BOAS assembly.

FIG. 5 further shows a first bend line 520 and a second bend line 522. The exemplary bend lines 520 and 522 intersect the associated leg proximal end branches so that the bending of the RMC at the bend lines provides a corresponding radial aiming of the branches and thus of the ends of the corresponding outlet passageways. For example, FIG. 6 shows the outlet passageway 165 having a distal portion 291 radially departing relative to a proximal portion 292 in-plane with the associated leg 90. The distal portion 291 extends to the outlet 105 departing slightly radially inward by an angle $\theta_O$. Such inward radial aiming/orientation may help resist ingestion of gas from the hot gas path 524 into the inter-segment space 526. For non-zero $\theta_O$, exemplary values of $\theta_O$ are 5-30°.

As in the U.S. Ser. No. 11/502,046 application, by using free distal ends of the RMC legs to cast closed passageway leg ends, the prior art plug welding step can be eliminated or reduced. However, the lack of local connection of the core leg free distal ends to the adjacent core end portion 202 or 204 may compromise structural integrity. To at least partially compensate, the RMC 200 has connecting portions 260, 262, 264, 266, and 268 connecting the main body portions of the adjacent legs. These connecting portions end up casting the passageways 120, 122, 124, 126, and 128, respectively.

From an airflow perspective, the connecting portions may advantageously be positioned at locations along the adjacent legs wherein air pressure in the cast passageway legs will be equal. This may minimize cross-flow and reduce losses. However, such location may provide less-than-desirable RMC strengthening. Thus, the connecting portions may be shifted (e.g., pushed circumferentially outward) relative to the optimal pressure balancing locations.

FIG. 5 also schematically shows a shell 280 having an internal surface 282. The shell 280 is formed over a wax pattern containing the RMC 200 for casting the BOAS. After dewaxing, casting, and deshelling/decoring, the inlets 60, 62, 64, 66, 68, 70, and 72 may be drilled (e.g., as part of a machining process applied to the raw casting).

There may be one or more advantages to using the exemplary RMC 200 or modifications thereof. The use of paired/dual outlets (e.g., 100, 101; 104, 105; 112, 113; and 114, 115) may more evenly distribute the cooling and may provide better overall cooling for a given mass flow rate of cooling air. For example, this may be seen in the outlets 100, 101. These may be compared with a single central baseline outlet (e.g., longitudinally centered near the end 132 of the leg 82). The outlet 100 is offset longitudinally downstream by a length L. This brings the outlet 101 closer to the adjacent end 134 of the adjacent downstream leg 84 to provide enhanced local cooling along the end 28. The centerline 510 of the passageway of outlet 101 is oriented off longitudinal by an angle θ (e.g., and off circumferential by 90° minus θ). Exemplary θ is 90°+/−45°. Where θ is off-normal, exemplary θ is 10-45° off-normal. This downstream angling may facilitate a greater offset L than would otherwise be possible, locating the outlet 101 downstream/aft of the downstream extremity of the leg 82 at the end 132. In addition to simply offsetting the outlets, the outlet exit angles (including off-radial components) may be chosen to use the exit air momentum as purge air to counter any tendencies for local gas ingestion between segments (as noted previously).

Additionally, as in U.S. patent application Ser. No. 11/502,046, use of the RMC with free distal leg portions may avoid or reduce the need for plug welding. Use of an RMC relative to a ceramic core may permit the casting of finer passageways. For example, core thickness and passageway height may be reduced relative to those of a baseline ceramic core and its cast passageways. In addition, the use of RMC may allow outlets to be significantly narrower. The narrowing facilitates the splitting a single outlet into two or more discrete outlets for better local control over the cooling and purge air. Exemplary RMC thicknesses are less than 1.25 mm, more narrowly, 0.5-11.0 mm. The RMC may also readily be provided with features (e.g., stamped/embossed or laser etched recesses) for casting internal trip strips or other surface enhancements.

Further variations may involve radially constricting one to all of the interconnecting passageways (e.g., 120, 122, 124, 126, and 128) to have a smaller thickness (radial height) than characteristic thickness (e.g., mean, median, or modal) of the adjacent passageway legs. This may be provided by a corresponding thinning of the RMC connecting portions (e.g., 260, 262, 264, 266, and 268). Exemplary thinning may be from one or both RMC faces and may be performed as part of the main cutting of the RMC or later.

Further variations may involve forming one or more of the legs with outlets at both ends of such leg. For example, flow throughout the ports relatively near the inlet ports may be facilitated by walls and/or posts within the associated leg between the inlet port and such outlet port (e.g., as is shown in U.S. patent application Ser. No. 11/529,120, the disclosure of which is incorporated by reference herein in its entirety as if set forth at length).

One or more embodiments have been described. Nevertheless, it will be understood that various modifications may be made. For example, when implemented in the reengineering of a baseline BOAS, or using existing manufacturing techniques and equipment, details of the baseline BOAS or existing techniques or equipment may influence details of any particular implementation. Accordingly, other embodiments are within the scope of the following claims.

What is claimed is:

1. A blade outer airseal segment comprising:
a forward longitudinal end;
an aft longitudinal end;
a first circumferential end;
a second circumferential end;
an ID face;
a plurality of circumferential passageway legs having outboard inlet ports and including:
a plurality of first said legs each having at least one outlet along the second end; and
a plurality of second said legs each having at least one outlet along the first end,
wherein:
at least one of the first legs or second legs includes a pair of outlet passageways longitudinally diverging.

2. The blade outer airseal of claim 1 wherein:
said pair comprises a first said outlet passageway longitudinally diverging forward and a second said outlet passageway longitudinally diverging aftward.

3. The blade outer airseal of claim 2 wherein:
said at least one of the first legs or second legs includes at least one of the first legs and at least one of the second legs.

4. The blade outer airseal of claim 1 wherein:
said at least one of the first legs or second legs includes at least one of the first legs and at least one of the second legs.

5. The blade outer airseal of claim 1 wherein:
at least one outlet passageway of the pair of outlet passageways is angled radially inward.

6. The blade outer airseal of claim 5 wherein:
said at least one outlet passageway is angled radially inward by 5-30°.

7. The blade outer airseal of claim 5 wherein:
the other outlet passageway of said pair of outlet passageways is also angled radially inward.

8. A casting core comprising:
first and second end portions; and
a plurality of legs including:
a plurality of first legs, each having:
an end joining the first end portion; and
a main body; and
a plurality of second legs, each having:
an end joining the second end portion;
a main body; and
wherein:
said end of at least one of the first legs or second legs comprises a pair of diverging branches.

9. The casting core of claim 8 wherein:
the branches are bent along a longitudinal bend line.

10. The core of claim 9 wherein:
the branches are bent 5-30° transverse to the main body portion.

11. The core of claim 8 wherein:
the core is formed of refractory metal sheetstock.

12. The core of claim 11 wherein:
the core has a ceramic coating.

13. The core of claim 11 wherein:
the sheetstock has a thickness of 0.5-1.0 mm.

14. The core of claim 8 wherein:
said end consists essentially of said pair of diverging branches.

15. The core of claim 8 further comprising:
at least one third leg connecting the first end portion to the second end portion.

16. The core of claim 15 wherein:
said at least one third leg includes first and second perimeter legs.

17. The core of claim 8 further comprising:
a plurality of connector branches connecting adjacent pairs of said legs and having minimum cross-section smaller than adjacent cross-sections of the connected legs.

18. The core of claim 17 wherein:
the connector branches have smaller thickness than characteristic thickness of the connected legs.

19. A raw casting, shell, and core combination comprising:
shell;
the core of claim 8; and
a casting partially over said core, said ends projecting from the casting into the shell.

20. A method for cooling a blade outer airseal, the segment comprising:
a forward longitudinal end;
an aft longitudinal end;
a first circumferential end;
a second circumferential end;
an ID face;
a plurality of circumferential passageway legs having outboard inlet ports and including:
a plurality of first said legs each having at least one outlet along the second end; and
a plurality of second said legs each having at least one outlet along the first end,
the method comprising:
introducing cooling air to the first legs and the second legs;
passing the cooling air in the first legs to the at least one outlet thereof;
passing the cooling air in the second legs to the at least one outlet thereof;
discharging the air from the at least one outlet of at least one of the first legs or second legs to branch and longitudinally diverge.

* * * * *